United States Patent [19]

Jessop et al.

[11] Patent Number: 4,600,452

[45] Date of Patent: Jul. 15, 1986

[54] EUTECTIC MICROKNIT COMPOSITE EXPLOSIVES AND PROCESSES FOR MAKING SAME

[75] Inventors: Harvey A. Jessop, Lehi; M. Taylor Abegg, Salt Lake City; John A. Peterson, Brigham City; Jay W. Butler, Bountiful, all of Utah; Ronald F. McCormick, Wilmslow, England; Ormond F. Lavery, personal representative of said Harvey A. Jessop, deceased

[73] Assignee: Megabar Explosives Corporation, Ogden, Utah

[21] Appl. No.: 578,179

[22] Filed: Feb. 8, 1984

[51] Int. Cl.[4] ..... C06B 45/10

[52] U.S. Cl. ..... 149/19.3; 149/18; 149/19.1; 149/19.5; 149/19.6; 149/19.9; 149/19.91; 149/40; 149/41; 149/42; 149/43; 149/44; 149/45; 149/46; 149/47; 149/61; 149/62; 149/70; 149/76; 149/77; 149/78; 149/83; 149/85; 149/92

[58] Field of Search ..... 149/18, 19.1, 19.3, 149/19.5, 19.6, 19.9, 19.91, 40–47, 61, 62, 70, 76, 77, 78, 83, 85, 92

[56] References Cited

U.S. PATENT DOCUMENTS

| | | | |
|---|---|---|---|
| 3,004,842 | 10/1961 | Rowlinson | 52/14 |
| 3,996,078 | 12/1976 | Klunsch et al. | 149/2 |
| 4,110,136 | 8/1978 | Hershkowitz | 149/47 |
| 4,128,442 | 12/1978 | Barlow | 149/46 |
| 4,248,644 | 2/1981 | Healy | 149/21 |
| 4,391,659 | 7/1983 | Smith | 149/2 |
| 4,434,017 | 2/1984 | Smith et al. | 149/2 |

FOREIGN PATENT DOCUMENTS 2125782 3/1984 United Kingdom .

*Primary Examiner*—Stephen J. Lechert, Jr.
*Attorney, Agent, or Firm*—K. S. Cornaby

[57] ABSTRACT

A new arrangement of matter is developed which can be formulated to be a high explosive, a propellant or a gas generator. The new arrangement of matter in its explosive embodiment is known as a eutectic microknit explosive (EMCX) in which an essentially anhydrous eutectic mixture of ammonium nitrate, soluble explosive, and other oxidizing salts is mixed with surfactants and organic fuels while the eutectic mixture is molten, and a microcrystalline property is created which imparts a hard, machinable characteristic to the arrangement of matter. The invention includes three processes for making MCX compositions; (1) dissolving surfactants, crystal-habit modifiers, thickeners or combinations into the molten eutectic mixture in a manner which permits supercooling with subsequent solidification; (2) forming an unstable oil-continuous emulsion as a preliminary step, followed by a controlled disruption of the oil-phase continuum which causes the composition to solidify after supercooling, and (3) retarding crystal nucleation in salt-continuous emulsions by introducing surfactants, thickeners, crystal-habit modifiers or combinations, along with immiscible fuels, resulting in supercooling and subsequent solidification to a hard composition.

29 Claims, No Drawings

EUTECTIC MICROKNIT COMPOSITE EXPLOSIVES AND PROCESSES FOR MAKING SAME

BACKGROUND OF THE INVENTION

The availability and low cost of ammonium nitrate (AN) have resulted in its widespread use in explosive formulations for commercial blasting. The simplest of these formulations is a mixture of AN and fuel oil (ANFO) in the ratio of approximately 94.5:5.5 by weight. Other formulations include a wide assortment of slurries and emulsions which have been developed to provide advantages over ANFO in handling, water resistance and improved performance.

The success of commercial AN formulations has attracted attention to the possible use of AN as a major ingredient in military explosives. For military applications, however, the developmental thrust has been directed primarily at ways of utilizing more effectively the energy available from explosives containing AN. Typically, AN formulations do not behave ideally in the explosive sense in that the energy release is not sufficiently prompt to yield theoretical possible detonation velocities and pressures. Development of methods to correct this deficiency has been an important part of military research and development efforts over the past several years.

One approach has been to form low-melting eutectics comprised of AN and one or more explosive fuels. Eutectics offer increased intimacy of the ingredients, low melting points near those normally used in munitions loading plants and melt-cast properties compatible with conventional military loading operations. Increased intimacy of the ingredients results in improved performance in some instances.

Typical of the eutectic composite formulations under evaluation at this time is one comprised of ethylenediamine dinitrate (EDD) and AN in the ratio 49:51 by weight, called EA, with a melting point of approximately 103° C. When the AN portion is modified to contain a ratio of 85:15 AN/$KNO_3$ by weight, the formulation is now called EAK. $KNO_3$ has been added to phase stabilize AN over the temperature range from −65 degrees F. to 165 degrees F. Other modifications include an additional ingredient, such as nitroguanidine, which lowers the melting temperature still further, to approximately 98° C., when present to the extent of 8% by weight of the composition (NEAK). Another composite formulation typical of AN based composite explosive is a 2:1 mole ratio of AN:ammonium 3,5-dinitro-1,2,4-triazolate.

Melt-cast loading operations typically involve large quantities of molten explosives. The hazards involved require that large distances separate accumulated quantities of explosives, and long dwell times at elevated temperatures are a matter of concern. Shrinkage with attendant cast defects is a troublesome problem, worsened by the elevated temperatures at which melt-cast formulations are delivered to the containers into which they are cast. The large temperature excursions required for cooling further complicate the process by permitting settling of solid additives with attendant density gradients, as well as long periods of time required for cooling before the castings can be moved. These problems pose serious limitations upon production rates.

SUMMARY OF THE INVENTION

It is the principal objective of this invention to formulate essentially anhydrous compositions involving intimate mixtures of molten AN and soluble explosives, along with surfactants and hydrocarbons, into a fluid mixture having those characteristics which allow supercooling with subsequent solidification. It is also an objective simultaneously to achieve a thickening effect in the fluid mixture by the choice of the surfactants and soluble hydrocarbon fuels used.

It is another objective to formulate the compositions in a manner which will permit continuous processing, cooling, optional admixing of additives, and loading or packaging before solidification.

It is a further objective to achieve improved water resistance in the final solid microcrystalline products.

The ability of the compositions described above to supercool to ambient or near ambient temperatures before solidification occurs can significantly reduce problems associated with melt-cast operations, specifically those related to shrinkage, density gradients and separation of solid additives. Cooling times normally required in melt-cast operations can be greatly reduced by the cooling of these compositions during the manufacturing process. The compositions can then be loaded into empty containers while still pumpable fluids. This facilitates production by eliminating the direct handling of hot explosives.

This invention describes processes and ingredients by which the above objectives are achieved in explosive compositions. Propellants and gas generators can also be produced by the process and ingredients of this invention. (To avoid redundancy in the discussion which follows, express reference to propellants and gas generators has been limited. However, it is emphasized that the discussion contemplates equally explosives, propellants and gas generators.) The invention effects a new arrangement of matter in which an essentially anhydrous mixture of inorganic oxidizer salts (primarily AN), soluble explosives, surfactants and organic fuels is intimately mixed while the oxidizer is molten, and a microcrystalline property is created which imparts a hard machinable characteristic to the final product. An explosive embodying this invention is called a eutectic microknit composite explosive (EMCX).

It has been found that there are at least three distinctly different methods whereby EMCX compositions are attainable. The first method involves dissolving surfactants, crystal habit modifiers, thickeners or combinations into the molten oxidizer. Proper selection and concentration of these ingredients permits supercooling with subsequent solidification resulting in a hard microcrystalline product.

A second method involves the formation of an unstable oil-continuous emulsion as a preliminary step, followed by a controlled disruption of the oil-phase continuum which causes the composition to solidify after supercooling. In this process a mixture of emulsifer and immiscible oil-like fuel is added to molten oxidizer(s), and an oil-continuous emulsion is formed by mixing. Supercooling is effected by restriction of the size of the oxidizer droplets and their separation from other droplets by the oil-continuous phase. The emulsions, however, are designed to be unstable, i.e., they are deliberately formulated to assure disruption of the oil continuum with subsequent solidification into a hard microcrystalline product.

A third method by which EMCX compositions can be made involves salt-continuous emulsions. In these emulsions crystallization normally occurs much more rapidly than in destabilized oil-continuous emulsions. To make the desired EMCX compositions by the salt-continuous emulsion route requires that crystal nucleation be retarded by thickeners or crystal habit modifiers or both. By thus retarding crystal nucleation the desired supercooling is achieved with subsequent solidification to a hard product.

Each of these methods permits the manufacturing of numerous EMCX formulations in a manner which minimizes both the quantity of neat explosive and residence time at the manufacturing temperature. Safety is greatly enhanced since only small quantities are in process at a given time, which makes practical the use of ingredients which have been hitherto impractical or unsafe.

DETAILED DESCRIPTION OF PREFERRED EMBODIMENTS

As examples of the first method described in the summary, mixes 1 through 3 in Table I involved no immiscible fuels. Nevertheless, the desired supercooling and microcrystalline, hard product was achieved.

As discussed in the second method, the desired EMCX properties can also be obtained by forming an oil-continuous emulsion as a preliminary step. Mixes 4 through 8 are examples of formulations made by this method. In these formulations the preliminary emulsions were formed with very little mixing when preheated mixtures of the appropriate surfactants and fuels were added to the molten oxidizer. In each case the oil-phase continuity of the original emulsion was destroyed to achieve the desired EMCX properties. In mixes 4 through 7 the emulsions were made to be unstable by the choice of the emulsifiers and surfactants. Mix 8 was designed originally as a stable emulsion having grease-like properties at ambient temperatures, but to which a surfactant (hexylaminenitrate) was added to destroy the oil-phase continuum. This caused the composition to solidify and display EMCX properties. The solid EMCX product was less sensitive than its precursor emulsion.

As discussed in method three, the desired EMCX properties can also be obtained using salt continuous emulsions as a preliminary step. Mixes 9 through 11 use this method. In this type of emulsion the desired supercooling may be achieved if the fuels and surfactants allow very fine ingredient intimacy and if the viscosity of the mixture is sufficiently high to retard molecular movement and thus crystal growth. Crystal habit modifiers are also helpful because of their added influence upon nucleation and crystal growth. These emulsions are made in the same manner as in method two except that high shear mixing is usually required.

Note that in mixes 3, 5, and 11 polymerizable ingredients were employed as the fuel. When polymers are used as fuels an elastomeric property may be imparted to the product. An elastomeric property is mandatory in many explosive, propellant and gas generator applications.

(A key to ingredient abbreviations follows the table.)

TABLE I

| | EMCX Formulations | | | | | | | | | | |
|---|---|---|---|---|---|---|---|---|---|---|---|
| Mix No. | 1 | 2 | 3 | 4 | 5 | 6 | 7 | 8 | 9 | 10 | 11 |
| Formulation (wt %) | | | | | | | | | | | |
| $NH_4NO_3$ | 44.0 | 50.0 | 45.0 | 43.0 | 45.0 | 70.0 | 25.0 | 46.0 | 37.0 | 46.0 | 45.0 |
| $KNO_3$ | 8.0 | — | — | — | — | — | — | 8.0 | 7.0 | 8.0 | — |
| $KClO_4$ | — | 10.0 | — | 10.0 | 10.0 | 10.0 | 5.0 | — | — | — | 10.0 |
| $Mg(ClO_4)_2$ | — | 20.0 | — | — | 25.0 | — | 15.0 | — | 20.0 | — | 25.0 |
| $LiNO_3$ | — | — | 15.0 | — | — | — | — | — | — | — | — |
| EDD | — | — | 30.0 | 43.0 | — | 14.0 | 50.0 | 40.0 | — | — | 10.0 |
| MEAP | — | 10.0 | — | — | 12.0 | — | — | — | 30.0 | — | — |
| EDNP | 40.0 | — | — | — | — | — | — | — | — | — | — |
| HDZN | — | — | — | — | — | — | — | — | — | 40.0 | — |
| $K^+$ Linoleate | — | — | 10.0 | — | — | — | 1.0 | — | — | — | — |
| Armac HT | — | — | — | 1.0 | 2.0 | — | — | — | — | — | — |
| SDBS | — | — | — | — | — | 1.0 | 1.0 | — | 1.0 | 1.0 | 1.0 |
| SMO | 4.0 | 5.0 | — | — | — | 1.0 | — | 1.5 | — | 1.0 | 1.0 |
| Petro AG | — | — | — | — | — | — | — | — | 2.0 | 2.0 | 1.0 |
| HAN | 2.0 | 5.0 | — | — | — | — | — | 1.0 | — | — | 1.0 |
| Modified Guar | 2.0 | — | — | — | — | — | — | — | — | — | — |
| Mineral oil | — | — | — | 3.0 | — | — | 3.0 | 3.5 | — | 1.0 | — |
| Coal tar naphtha | — | — | — | — | 1.0 | 4.0 | — | — | 2.0 | 1.0 | — |
| Polystyrene Resin | — | — | — | — | 5.0 | — | — | — | — | — | — |
| Terrecol 2900 | — | — | — | — | — | — | — | — | — | — | 2.60 |
| Method | 1 | 1 | 1 | 2 | 2 | 2 | 2 | 2 | 3 | 3 | 3 |
| Results @ 10 5° C. in 6.3 cm dia. | | | | | | | | | | | |
| Density (g/cc) | 1.5 | 1.4 | 1.55 | 1.55 | 1.6 | 1.55 | 1.55 | 1.55 | 1.55 | 1.6 | 1.6 |
| 15 gm booster | det | det | fail | fail | fail | fail | det | fail | det | det | fail |

INGREDIENT KEY TO TABLES

SDBS = Sodium dodecylbenzene sulfonate
SMO = Sorbitan monooleate
HAN = Hexylamine nitrate
Petro AG = Sodium dimethylnaphthalene sulfonate
Terecol 2900 = Polytetrahydrofuran
EDD = Ethylenediamine dinitrate
MEAP = Monoethylamine perchlorate
EDNP = Ethylenediamine mononitrate monoperchlorate
Armac HT = a hydrogenated fatty amine acetate
K+Linoleate = potassium linoleate
HDZN = hydrazine nitrate Note that whatever method is employed, various types of surfactants are applicable. Various oxidizer combinations, explosives, and immiscible fuels are also useable, with typical EMCX physical and explosive properties resulting.

It has been shown that the desired physical and explosive properties are attainable by different methods, and that one of the desired properties is the capacity to supercool before solidification. A broad range of ingredients has also been shown to be applicable in contrast to the narrower range applicable to stabilized oil-continuous emulsions and melt-cast explosives.

It has been observed that mixtures of AN with certain other oxidizing salts or fuels or combinations have significantly lowered melting points from those of AN and the other oxidizing salts in the mixtures. Such mixtures are particularly useful in EMCX compositions because the melting points of such mixtures are low enough to permit the use of oxidizer salts and fuels not ordinarily useable.

EMCX formulations also lend themselves to the use of an extended range of fuels including thermoplastic polymers, crosslinkable polymers, and polymerizable fuels. Formulations which make use of polymeric fuels are especially applicable to rocket propellants and gas generators. Polyethylene, polystyrene esters, and crosslinkable polyols are examples of polymeric materials which have been employed in EMCX formulations, some of which are illustrated in Table I.

Thus, by each of the three methods described, it is possible to produce AN-based compositions in which a significantly broader range of ingredients is applicable. Therefore, a correspondingly broad range of claims relating to ingredients is a necessary consequence.

We claim:

1. An arrangement of matter which is a solid, microcrystalline explosive, propellant or gas generator, comprising in combination:

an essentially anhydrous mixture of ammonium nitrate and soluble explosives(s), surfactant(s), hydrocarbon fuel(s) and other inorganic oxidizer salt(s), including at least one such salt which is not a nitrate salt, involving the intimate mixing or dissolving of ingredients while they are in the molten state, the intimately mixed fluid having the property of permitting the molten salt(s) to be supercooled before the occurrence of crystal nucleation and reversion from the fluid state and wherein moisture which may be present is water of hydration or because of the hygroscopic nature of said oxidizer salts or explosive and is limited to 3% maximum by weight of the composiition.

2. An explosive of claim 1 wherein soluble fuels or soluble compound explosives may be employed in the oxidizer portion of the originally fluid mixture.

3. An explosive of claim 1 wherein the oxygen balance is between +5% and −30%.

4. An explosive of claim 1 wherein the composition employs metallic fuels, in which case the oxygen balance is between +5% and −50%.

5. An explosive of claim 1 wherein the surfactant concentration is from 0.05% to 10% of the composition by weight.

6. An explosive of claim 1 wherein other inorganic nitrates or perchlorates may be added in conjunction with $NH_4NO_3$; the total concentration of the added salt or salts is limited to 48% by weight of the composition; and no single added salt is present in concentration greater than the percentage by weight of $NH_4NO_3$ in the composition.

7. An explosive of claim 6 wherein the added oxidizers are selected from the group consisting of alkali and alkaline earth nitrates and perchlorates and $NH_4CLO_4$.

8. An explosive of claim 7 wherein the added oxidizer is selected from the group consisting of $Zn(NO_3)_2$, $Mn(NO_3)_2$, $Cu(NO_3)_2$, $Pb(NO_3)_2$ and their perchlorate analogs.

9. An explosive of claim 6 wherein any soluble and compatible potassium salt is added to phase stabilize the $NH_4NO_3$.

10. An explosive of claim 1 wherein the fuel is polymerizable or crosslinkable and where polymerization or crosslinking or both may be accomplished in situ.

11. An explosive of claim 1 wherein the fuel is a thermoplastic polymer.

12. An explosive of claim 10 wherein the polymerizable fuels are selected from the group consisting of polyesters, polyethers, polydienes, polysulfides, polyperflourocarbons, polyolefins, polyamines, polyalkanes, polyphenols and polyacetylenes.

13. An explosive of claim 1 wherein the hydrocarbon fuel is nonpolymerizable.

14. An explosive of claim 1 wherein the surfactants are emulsifiers selected from the group having R-groups greater than 12 carbon atoms in length ordinarily used to form oil-continuous emulsions.

15. An explosive of claim 1 wherein the surfactants are selected from the group having a carbon chain length of from 6 to 12 carbon atoms ordinarily used for water-continuous emulsions.

16. An explosive of claim 1 wherein additives selected from the aromatic or alkylaryl surfactants may be employed.

17. An explosive of claim 1 wherein the surfactants are crystal habit modifiers selected from the dialkylnaphthalene-sulfonates.

18. An explosive of claim 1 wherein the originally fluid mixture may be employed as a matrix into which insoluble solids may be added.

19. An explosive of claim 18 wherein the added solid is a compound explosive.

20. An explosive of claim 18 wherein the added solid is a metallic fuel.

21. An explosive of claim 1 wherein the soluble compound explosive is the nitrate or perchlorate adduct of an alkylamine or alkanolamine.

22. An explosive of claim 1 wherein the soluble compound explosive is an oxidizer.

23. An explosive of claim 1 wherein molten compound explosives which are insoluble may be dispersed in the originally fluid mixture.

24. An explosive of claim 18 wherein the insoluble solid additive may be an oxidizer.

25. An explosive of claim 1 wherein the compound explosive is selected from the group consisting of hexamethylenetetraminenitrates or hexamethylenetetramine perchlorates made in situ.

26. An explosive of claim 1 wherein a compound explosive selected from the group consisting of metal ammonia coordination compounds is added.

27. An explosive of claim 1 wherein the soluble compound explosive is a nitroazole salt.

28. An explosive of claim 4 wherein density control or sensitization is achieved by the use of additives selected from microballoons, perlite, fumed silica, entrained gas, or gas generated in situ.

29. An explosive of claim 1 wherein no sensitization is effected by either density control or the addition of compound explosives.

* * * * *